US007077242B2

(12) United States Patent
Cocher

(10) Patent No.: US 7,077,242 B2
(45) Date of Patent: Jul. 18, 2006

(54) DEVICE FOR CONNECTING A CAR DOOR WITH A SHAFT DOOR AND FOR LOCKING AND UNLOCKING THE DOORS, A DEVICE FOR EMERGENCY UNLOCKING OF A CAR DOOR AND A METHOD FOR EMERGENCY UNLOCKING A CAR DOOR

(75) Inventor: Stéphane Cocher, Versailles (FR)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/943,538

(22) Filed: Sep. 17, 2004

(65) Prior Publication Data

US 2005/0145442 A1 Jul. 7, 2005

(30) Foreign Application Priority Data

Sep. 17, 2003 (EP) ..... 03405680

(51) Int. Cl.
*B66B 13/12* (2006.01)
*B66B 13/06* (2006.01)

(52) U.S. Cl. ..... 187/330; 187/333

(58) Field of Classification Search ..... 187/330, 187/333

See application file for complete search history.

(56) References Cited

U.S. PATENT DOCUMENTS 2,193,860 A * 3/1940 Crane ..... 187/319
3,065,826 A * 11/1962 Tucker, Jr. ..... 187/319
3,605,952 A * 9/1971 Lusti ..... 187/319
4,436,184 A * 3/1984 Dorman et al. ..... 187/331
4,947,964 A * 8/1990 Husmann ..... 187/319
5,246,089 A * 9/1993 Husmann et al. ..... 187/319
5,819,877 A * 10/1998 Rivera et al. ..... 187/314
5,988,320 A * 11/1999 Mittermayr ..... 187/319
6,021,871 A * 2/2000 Grabner ..... 187/335
6,164,417 A * 12/2000 Oberleitner ..... 187/319
6,173,815 B1 * 1/2001 Mittermayr ..... 187/330
6,189,658 B1 * 2/2001 Karner ..... 187/319
6,446,759 B1 * 9/2002 Kulak et al. ..... 187/330

FOREIGN PATENT DOCUMENTS

EP 1 266 860 12/2002
EP 1266860 A1 * 12/2002
JP 03152085 A * 6/1991

* cited by examiner

*Primary Examiner*—Kathy Matecki
*Assistant Examiner*—Eric E. Pico
(74) *Attorney, Agent, or Firm*—Butzel Long

(57) ABSTRACT

A device for connecting a car door with a shaft door and for emergency unlocking of a car door consists of an entrainer arranged at the car door, which entrainer detachably connects, together with a roller pair arranged at the shaft door, the car door with the shaft door, and of a first locking mechanism for locking and unlocking the car door and of a second locking mechanism for locking and unlocking the shaft door. When the doors are closed and locked the entrainer is closed and can freely move between the two rollers of the roller pair when the elevator car is traveling between two floors or past a floor not to be served. The first locking mechanism is controlled directly.

7 Claims, 4 Drawing Sheets

DEVICE FOR CONNECTING A CAR DOOR WITH A SHAFT DOOR AND FOR LOCKING AND UNLOCKING THE DOORS, A DEVICE FOR EMERGENCY UNLOCKING OF A CAR DOOR AND A METHOD FOR EMERGENCY UNLOCKING A CAR DOOR

BACKGROUND OF THE INVENTION

The present invention relates to a device for connecting a car door with a shaft door and for locking and unlocking the doors, a device for emergency unlocking of the car door and a method for emergency unlocking of a car door, wherein an entrainer, which is arranged at the car door, detachably connects, together with rollers arranged at the shaft door, the car door with the shaft door and a first locking mechanism locks and unlocks the car door and a second locking mechanism locks and unlocks the shaft door.

The car door is a component of an elevator car which is arranged to be movable along stopping points. The stopping points form access points for the elevator car and they are provided with shaft doors. The car door together with the shaft doors regulates access of elevator passengers or goods to the elevator car or to the stopping point. For this purpose, the car door is temporarily connected at the stopping point with the shaft door. Constrained locking means or locking mechanisms keep the car door and the shaft door locked when the car door is not disposed in the access region of the stopping point or is disposed in free travel and unlocks the car door and the shaft door when the elevator car is disposed in the access region of the stopping point and an access command is present.

A device is shown in the European Patent Specification EP 1 266 860 A1 by means of which a car door of an elevator car disposed in the region of a stopping point is opened in common with a shaft door. If the elevator car is located outside a stopping point, the car door remains locked by the same device. An entrainer parallelogram is closed for free travel and opens for coupling with the shaft door between two coupling rollers arranged at the shaft door. The encrainer parallelogram is guided by means of parallel levers and comprises a third rail which is actuated in the presence of the coupling rollers and thus unlocks the car door and in the absence of the coupling rollers, for example between the floors, leaves the car door in the locked position.

A disadvantage of the known device resides in the fact that the third rail with smallest dimensions has to be guided and mounted on a second rail. Moreover, a force element is required to keep the third rail in its operating position. This has the consequence that the device is sensitive to dirt and wear and thus maintenance-intensive. It needs many components and is thus cost-intensive.

A further disadvantage is a lack of emergency unlocking. This makes emergency evacuation of the elevator passengers difficult when the elevator car remains standing in the vicinity of a stopping point.

SUMMARY OF THE INVENTION

Here the present invention provides a remedy for avoiding the disadvantages of the known device and of providing a device for reliable and economic connecting of a car door with a shaft door and for locking and unlocking the doors and additionally provides the possibility of emergency unlocking.

The advantages achieved by the present invention are essentially that the movement of the parallel levers is transmitted by means of a lever pair and a rail directly to a first locking mechanism. The requirement for a third rail is eliminated. The resetting elements and bearing points required for positioning the third rail are thereby redundant. This simplifies production and assembly, whereby a component favorable in price arises. Components susceptible to maintenance and wear are eliminated, yet quick and reliable locking and unlocking of the car door remains ensured.

In addition to this normal operation of the locking mechanism, this can be directly controlled by means of an emergency lever for operation in an emergency evacuation without large additional outlay. The advantage of this emergency unlocking resides in the fact that the car door can be manually unlocked from outside in simple manner without complicated parts. With the help of this emergency unlocking means a specialist can quickly and reliably carry out emergency unlocking of the car door and thus rapidly perform emergency evacuation of elevator passengers in the case of need.

The present invention relates to a device for connecting a car door with a shaft door and for locking or unlocking the doors, wherein an entrainer attached to the car door has a pair of parallel rails that engage rollers attached to the shaft door to detachably connect the car door with the shaft door, a first locking mechanism locks and unlocks the car door and a second locking mechanism locks and unlocks the shaft door. The device includes a first pair of levers extending in parallel and each lever being rotatably mounted on the car door; and a second pair of levers, each lever of the second pair being pivotally connected with an associated lever of the first pair and having one end connected with one rail of the entrainer, each lever of the second pair being connected to the first locking mechanism whereby movement of the first pair of levers and the one rail is transmitted to the first locking mechanism.

Each lever of the second pair has a shorter arm and a longer arm, wherein the one rail is pivotably connected with the shorter arms and the first locking mechanism is pivotably connected with the longer arms. A locking bar in the first locking mechanism is pivotably connected with the second pair of levers and transmits vertical movement of the one rail to a first lock arranged at the car door. The first lock has a recess in which a bar pin of the locking bar engages, the recess being shaped to conform to movement of the one rail and the first pair of levers. The device according to the present invention includes an emergency lever pivotally mounted on the car door and actuatable into engagement with the first locking mechanism for unlocking the car door. The emergency lever is actuable by a pull means attached thereto such as a pull line.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
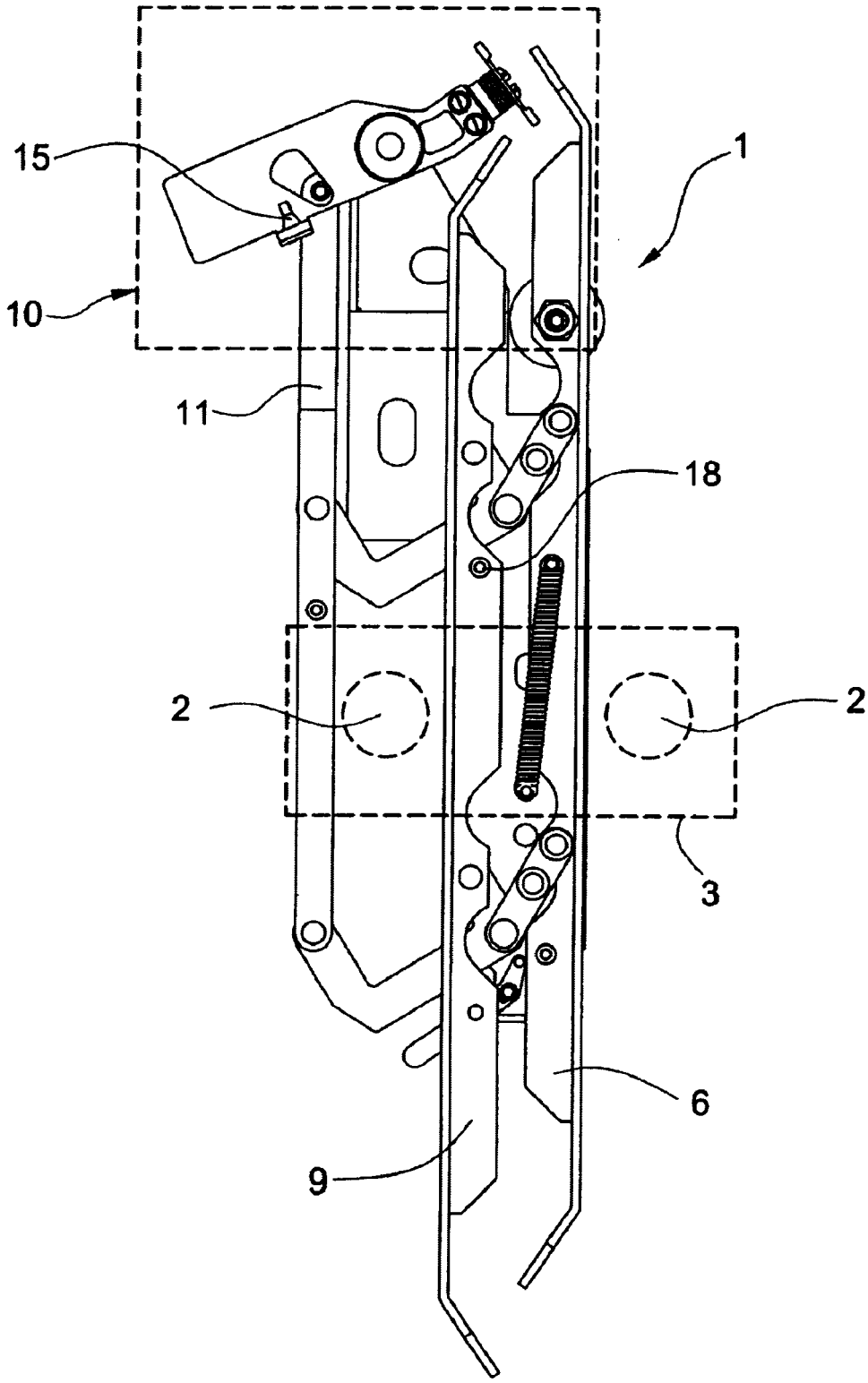
FIG. 1 is a schematic elevation view of a device according to the present invention for connecting a car door with a shaft door, the device being in a locked setting without latching.

FIG. 1 shows a device according to the present invention for connecting a car door with a shaft door and for locking and unlocking the doors. The device consists of an entrainer 1 arranged at the car door, which entrainer 1 detachably connects, together with a roller pair 2 arranged at the shaft door, the car door with the shaft door, and of a first locking mechanism 10 for locking and unlocking the car door and a second locking mechanism 3 for locking and unlocking the shaft door. When the doors are closed and the locked the entrainer 1 is, as shown in FIG. 1, closed and can move through freely between the roller pair 2, wherein the elevator car is on a journey between two stopping points or moves past a stopping point which is not to be served.

Figure 2:
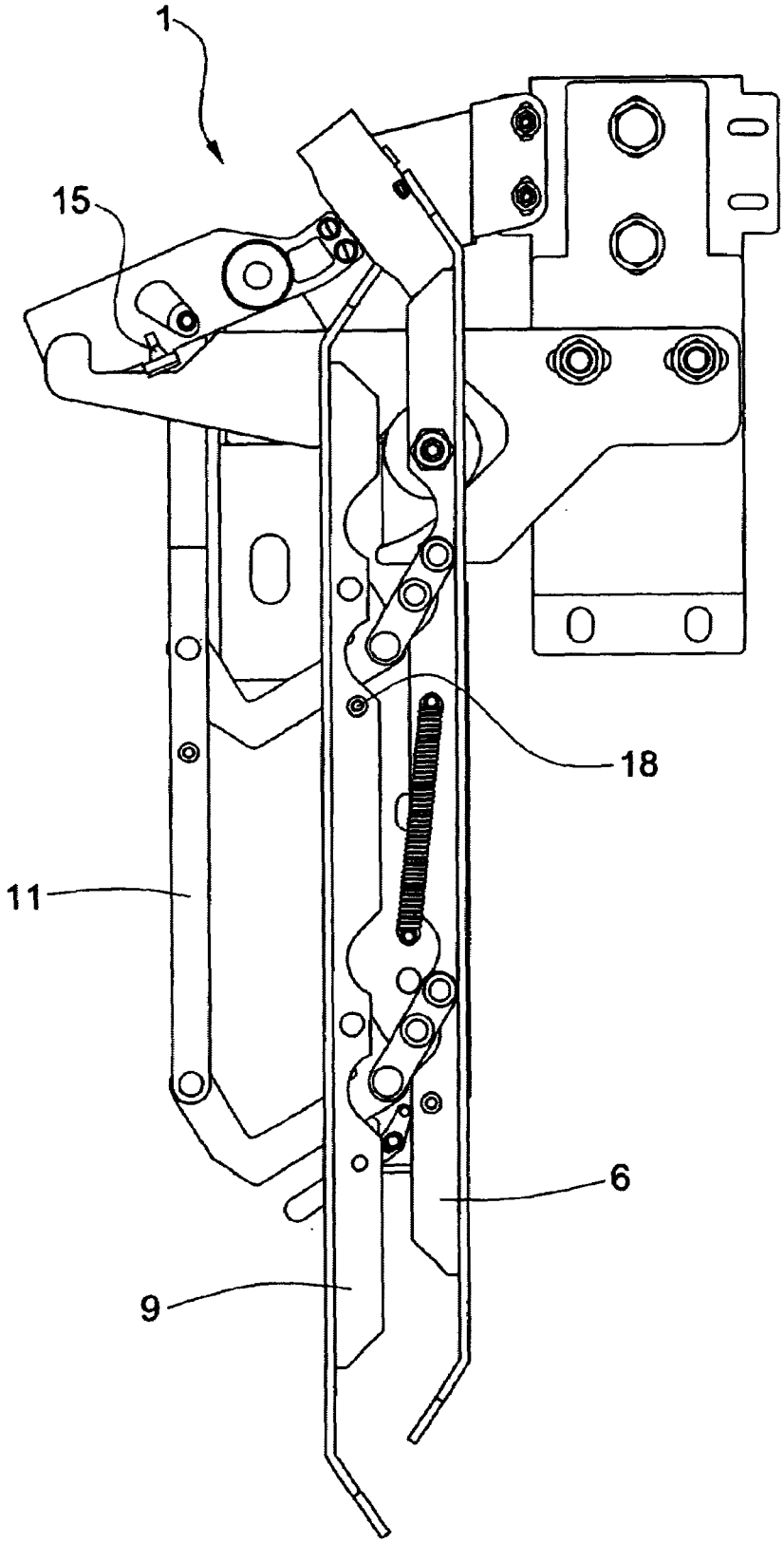
FIG. 2 is a view similar to FIG. 1 showing the device in a locked setting with latching.

FIG. 2 shows the device, in correspondence with FIG. 1, for connecting a car door with a shaft door and for locking and unlocking the doors, in the installed state. The entrainer 1 fastened to the car door is closed and enables free passage of the entrainer 1 between the roller pair 2. A locking detent 15, which is arranged on the entrainer 1, prevents opening of the car door as long as the locking detent 15 is disposed in the blocking range of a catch 16.

This closed setting, which is shown in accordance with FIGS. 1 and 2, of the entrainer 1 corresponds with the closed car door. This means the car door is traveling or at least ready to travel.

Figure 3:
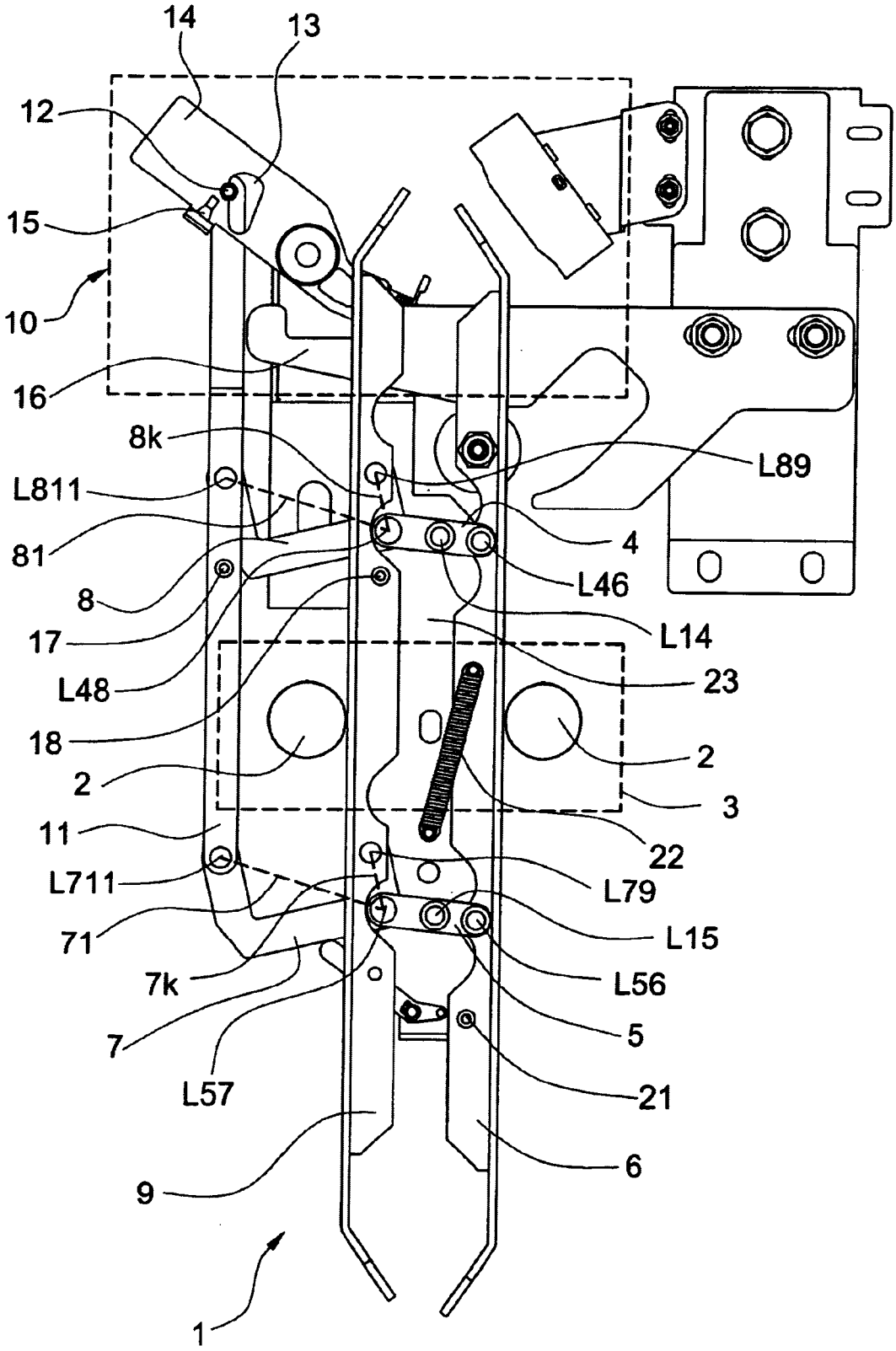
FIG. 3 is a view similar to FIG. 2 showing the device in an unlocked setting.

FIG. 3 shows the device, in correspondence with FIGS. 1 and 2, in an opened state. This means that the car door is connected with the shaft door by means of the entrainer 1 and the roller pair 2. The shaft door is unlocked by means of a known second locking mechanism or the shaft door unlocking means 3 and the locking detent 15 is not disposed in engagement with the catch 16. The car door can be moved.

An example of the mechanism of the entrainer 1 is explained in the following:

The entrainer 1 is connected with the car door by means of a base plate 23. At least two geometrically identical parallel levers 4, 5 are rotatably fastened on the base plate 23 at bearing points L14, L15. Further bearing points L46, L56, at which a rail 6 is rotatably fastened, are disposed at one end of the first pair of parallel levers 4, 5. The rail 6 forms, together with the parallel levers 4, 5, a first parallelogram open at one side. The parallel levers 4, 5 are guided in parallel by the rail 6. The movement of the rail 6 is limited by an end stop 21. As a rule a spring 22 and/or a control device (not further explained here), such as, for example, a control gate, defines the position of the first parallelogram. Further, a second pair of geometrically identical levers 7, 8 are rotatably fastened by means of bearing points L48, L57 at juxtaposed ends of the parallel levers 4, 5 opposite the rail 6. The levers 7, 8 have, at a shorter end 7*k*, 8*k*, a bearing point L79, L89 at which a second rail 9 is mounted. The rails 6, 9 form, together with the parallel levers 4, 5, the now-closed first parallelogram.

Bearing points L711, L811, at which a locking bar 11 is fastened, are arranged at second, longer ends 71, 81 of the levers 7, 8. The locking bar 11 is displaced in parallel with the rail 9 in correspondence with the movement of the second rail 9 and the bearing points L48, L57. The locking bar 11 forms, together with the rail 9 and the levers 7, 8, a second parallelogram. The movement of this second parallelogram is limited on the one hand by a lever stop 18 and on the other hand by a lock stop 17.

The locking bar 11 is held in a position, which is defined by the lever stop 18, substantially by the own weight of the locking bar 11 and the connected parts. The first and the second parallelogram have, by the second rail 9, a common part, whereby it is predetermined that the rails 6, 9 and the locking bar 11 displace in parallel in correspondence with the lever geometry of the parallel levers 4, 5 and the levers 7, 8.

The locking bar 11 is provided a pin 12, which controls a lock 14 by means of a lock gate 13. The locking detent 15 fixedly connected with the lock 14 is thereby controlled. The lock gate 13 is advantageously provided with a slideway lining or consists of a plastic materials inlay which has the requisite sliding and guiding properties. Alternatively, the pin 12 can obviously also be made of an appropriate sliding material.

The entrainer 1 is fastened on the car door in such a manner that the rails 6, 9 are oriented in correspondence with the travel direction of the elevator car.

In the case of the closed setting of the entrainer 1, the first parallelogram, as apparent in FIGS. 1 and 2, is compressed. The rails 6, 9 are disposed at a smallest possible distance. The smallest possible distance is in that case selected in such a manner that the roller pair 2 mounted at the shaft door side can be passed with sufficient play for through movement.

The locking bar 11 is disposed in its lower end setting which is produced by gravitational force and which is defined by the lever stop 18. The locking detent 15 is disposed in blocking setting relative to the catch 16. The catch 16 in that case allows the locking detent 15 a small travel. The car door is thus locked by means of the locking detent 15 and the catch 16.

If opening of the car door is initiated, the first parallelogram is opened by a control device. Through opening of the parallelogram, initially the play relative to the roller pair 2 arranged at the shaft door side is eliminated and thereafter the rollers of the roller pair 2 are urged apart. This urging apart of the rollers of the roller pair 2 enables unlocking of the shaft door by means of the shaft door lock 3. Simultaneously with the opening of the first parallelogram the locking bar 11 is moved synchronously with respect to the second rail 9. This movement of the locking bar 11 is taken up by the lock gate 13 provided in the lock 14 without the lock itself being actuated or without the locking detent 15 leaving its blocking setting with respect to the catch 16. Only the counterforce produced by the pressing-on of the rollers of the roller pair 2 obstructs the second rail 9 in its opening movement, whereby the locking bar 11 is additionally displaced by means of the levers 7, 8. This additional displacement causes, as shown in FIG. 3, actuation of the lock 14, whereby the locking detent 15 leaves its blocking setting. The connection of car door with shaft door is now produced and car door and shaft door are unlocked and can be opened and subsequently closed again. A reciprocal movement course correspondingly results in the case of this closing process.

If the elevator car is not disposed in the access region of a stopping point, the roller pair 2 at the shaft side is absent at this point in time. The counterforce produced by the pressing of the rollers of the roller pair 2 onto the second rail 9 thereby does not apply and the locking bar 11 does not undergo any additional displacement, for which reason also the lock 14 is not actuated. The locking detent 15 thereby remains in engagement with respect to the catch 16 and the car door remains locked.

The advantage of this arrangement resides in the fact that further moved elements such as a third rail with the associated bearing points are eliminated. Costs are thereby lowered and susceptibility to dirt and wear is reduced. At the same time a reliable and rapid locking and unlocking of the car door and shaft door is ensured.

In a further form of embodiment the car door can be unlocked by means of an emergency unlocking means.

Figure 4:
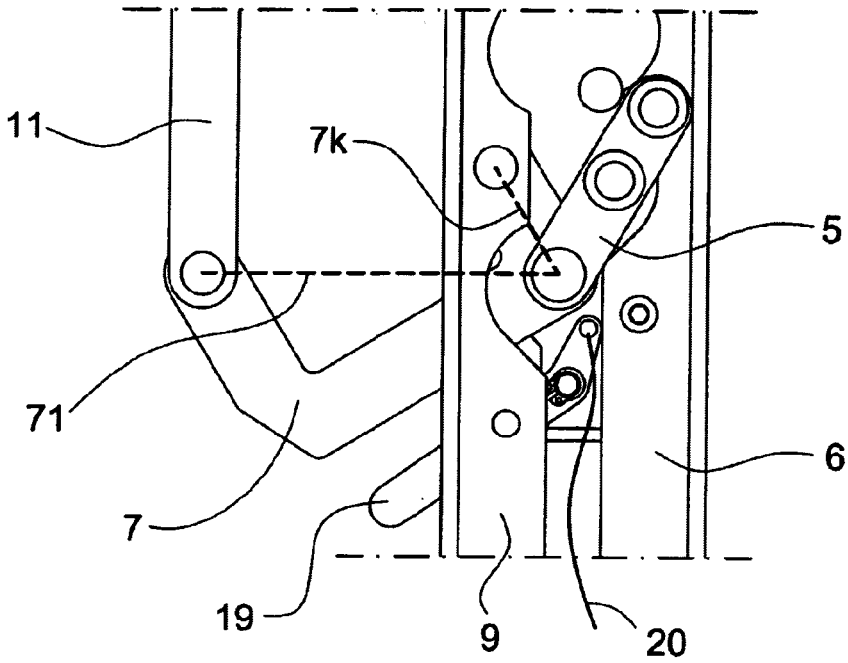
FIG. 4 is an enlarged fragmentary view of a lower portion of the device showing the emergency unlocking mechanism in a locked setting.

FIG. 4 shows a detail of a possible device for unlocking a car door in the example of the previously described connecting device. An entrainer is disposed in closed setting in correspondence with an embodiment shown in FIG. 1. An emergency lever 19 is disposed in readiness setting. The emergency lever is mounted on the base plate 23 to be rotatable. The emergency lever 19 is in that case arranged in such a manner that by means of rotation of the emergency lever 19 the locking of the car door can be directly or indirectly canceled. Rotation of the emergency lever can in that case be produced in different ways. In the illustrated example this is carried out by means of a line 20 fastened to the emergency lever 19.

Figure 5:
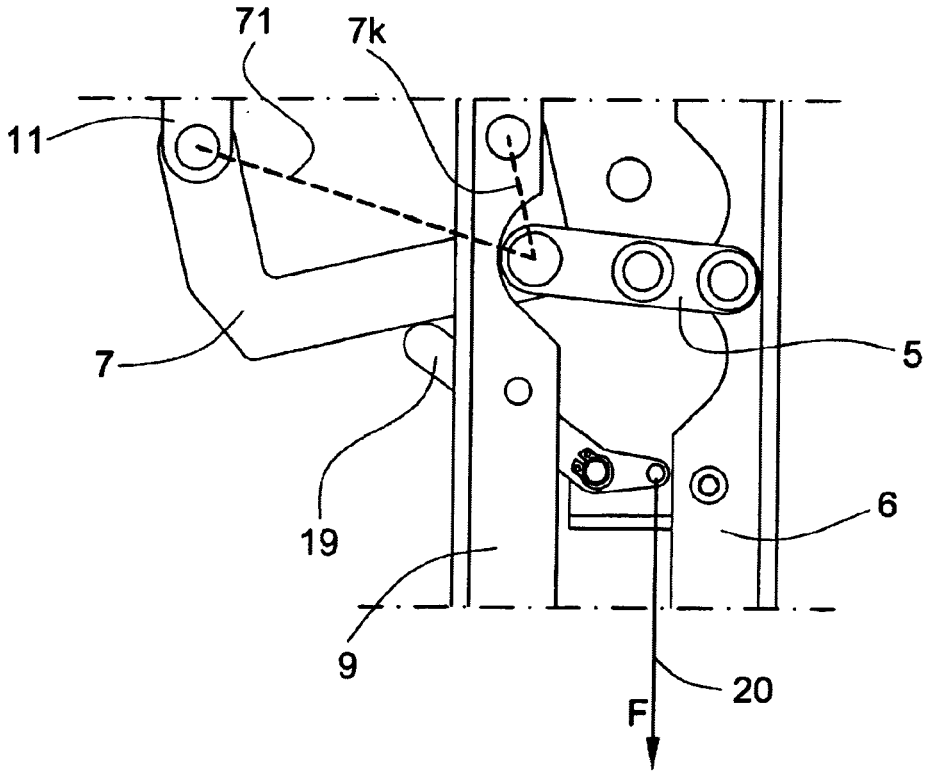
FIG. 5 is a view similar to FIG. 4 showing the emergency mechanism in an unlocked setting.

FIG. 5 shows the entrainer and therewith locking of the car door in unlocked form. The locking bar 11, which unlocks or locks the car door, is actuated by means of the emergency lever 19. The locking bar 11 thereby unlocks the locking mechanism 10, as illustrated in FIG. 3.

A car can for various reasons remain in the vicinity of a stopping point, but outside the normal access range with respect to the stopping point. This can take place, for example, as a consequence of voltage failure in the building, a fault in the control or a mechanical or electrical defect in the elevator installation. If the elevator car is now disposed slightly outside the normal access region, it is desired to free the elevator passengers by means of the car door and shaft door opening. An authorized specialist is now in a position, by virtue of the invention of a device for the emergency unlocking of a car door, to rapidly and conveniently free the elevator passengers.

If an elevator car is disposed in the described initial setting, slightly outside the normal access range, the authorized specialist can unlock the shaft door by means of a standard key and slide it open. An emergency unlocking of the shaft door with respect thereto is required in elevator standards and long known. If the expert now attempts to slide open the car door, this does not happen because the car door is, as descriptively shown in FIGS. 1 and 2, locked. For the purpose of emergency unlocking the emergency lever 18 is now arranged in such a manner, as shown in FIGS. 4 and 5, that pivoting of the same has the consequence of displacement of the lever 7, thus a displacement of the locking bar 11 and, as apparent in FIG. 3, unlocking of the locking detent 15 from the locking range of the catch 16, whereby the car door is unlocked. A pull line 20 is provided for simple actuation of the emergency lever 19. Thus, the emergency lever 19 can also be actuated when the entrainer is not disposed in the direct field of view of the authorized specialist. Other elements, such as a pull rod or similar means, are equivalent substitutes for the pull line 20.

After actuation of the emergency lever the elevator car can now be pushed open and the elevator passengers can leave the elevator car under the guidance of the specialist, with maintenance of necessary safety measures, such as, for example, securing the car against uncontrolled movements during the evacuation or securing any shaft openings.

The individual embodiment can obviously vary with knowledge of these descriptions. The movement course according to which unlocking takes place by opening of the entrainer can, for example, be reversed so that unlocking takes place on closing of the entrainer, or the illustrated levers can be adapted in their shape and size.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for connecting a car door with a shaft door and for locking or unlocking the doors, wherein an entrainer attached to the car door has a pair of parallel rails that engage rollers attached to the shaft door to detachably connect the car door with the shaft door, a first locking mechanism locks and unlocks the car door and a second locking mechanism looks and unlocks the shaft door, comprising:

a first pair of levers extending in parallel and each lever being rotatably mounted on the car door; and a second pair of levers, each lever of said second pair being pivotally connected with an associated lever of said first pair and having one end connected with one rail of the entrainer, each lever of said second pair being connected to the first locking mechanism whereby movement of said first pair of levers and the one rail is transmitted to the first locking mechanism.

2. The device according to claim 1 wherein each said lever of said second pair has a shorter arm and a longer arm, the one rail is pivotably connected with said shorter arms and the first locking mechanism is pivotably connected with said longer arms.

3. The device according to claim 1 including a locking bar in the first locking mechanism pivotably connected with said second pair of levers and which transmits vertical movement of the one rail to a first lock arranged at the car door.

4. The device according to claim 3 wherein said first lock has a recess in which a bar pin of said locking bar engages, said recess being shaped to conform with movement of the one rail and said first pair of levers.

5. The device according to claim 1 including an emergency lever pivotally mounted on the car door and actuatable into engagement with the first locking mechanism for unlocking the car door.

6. The device according to claim 5 wherein said emergency lever is actuable by a pull means attached thereto.

7. The device according to claim 6 wherein said pull means is a pull line.

* * * * *